United States Patent [19]

Lems et al.

[11] 4,156,385

[45] May 29, 1979

[54] METHOD OF READILY DISENGAGING ANTI-REVERSE SEALLESS STRAP CONNECTION TO FACILITATE REUSING STRAP

[75] Inventors: Peter Lems, Wilmette; William A. Meier, Hoffman Estates, both of Ill.

[73] Assignee: Signode Corporation, Glenview, Ill.

[21] Appl. No.: 934,400

[22] Filed: Aug. 17, 1978

[51] Int. Cl.[2] ..... B65B 13/02; B65B 13/24

[52] U.S. Cl. ..... 100/3; 24/20 EE

[58] Field of Search ..... 24/20 EE, 23 EE, 20 CW, 24/20 TT; 100/3, 8, 33, 29

[56] References Cited

U.S. PATENT DOCUMENTS

| | | | |
|---|---|---|---|
| 3,177,538 | 4/1965 | Timmerbeil | 24/20 EE |
| 3,235,924 | 2/1966 | Timmerbeil | 24/20 EE |
| 3,303,541 | 2/1967 | Beach | 24/20 EE |
| 3,515,055 | 6/1970 | Timmerbeil | 100/3 |
| 3,541,948 | 11/1970 | Sauer | 100/3 |
| 3,590,731 | 7/1971 | Nichols | 100/3 |
| 3,935,616 | 2/1976 | Simmons | 24/20 EE |
| 4,048,697 | 9/1977 | Duenser | 24/20 EE |
| 4,062,086 | 12/1977 | Wojcik | 24/20 EE |
| 4,080,689 | 3/1978 | Meier | 24/20 EE |

*Primary Examiner*—Billy J. Wilhite

*Attorney, Agent, or Firm*—Dressler, Goldsmith, Clement, Gordon & Shore, Ltd.

[57] ABSTRACT

A method is provided for binding a first low density bale with a plurality of straps and then reusing sections of the straps to bind a second, smaller bale which is compressed from the first bale. A plurality of primary straps are provided with a multiple of discrete arrays of longitudinally spaced joint elements, the joint elements of each array being adapted to interlock with the joint elements of another array to form a sealless connection therebetween. Each primary strap is looped around the first low density bale and the ends of the strap are connected through two of the arrays of interlocking joint elements. Each primary strap further has, at spaced locations along its length, severance indicia and readily disengageable anti-reverse engaging tabs. When desired, the first bale may be subsequently further compressed to allow removal of the primary straps. When this is done, the primary straps now being larger than the bale, may be pushed inwardly, in the region of the interlocking joint element connection, towards the bale surface to permit disengagement of the anti-reverse tabs and release of the connection. Next, with the preferred embodiment, each primary strap is severed in two places to create second and third strap segments and a disposable waste end portion. A number of similar second strap segments are connected together to form a composite strap of a length equal to the third strap segment. The bale can then be recompressed to a smaller size and bound with one or more equal lengths of the composite straps and third strap segments.

7 Claims, 8 Drawing Figures

METHOD OF READILY DISENGAGING ANTI-REVERSE SEALLESS STRAP CONNECTION TO FACILITATE REUSING STRAP

BACKGROUND OF THE INVENTION

This invention relates to the baling of compressible material, such as cotton, with metal strap. Specifically, this invention relates to a method for reusing metal strap from a first, large bale to strap a second, smaller bale which may have been compressed from the larger bale or which may be a completely different bale.

The method of the present invention relates to using strap of the type having a first joint-forming portion on one end and a second joint-forming portion on the other end, each end containing an array of longitudinally spaced joint elements adapted for interlocking with another similar array of joint elements. The connection formed between arrays of interlocking joint elements is known as a sealless connection. Many types of sealless connections are known and many such connections are described in the concurrently filed Lems et al. application entitled, "Strap For Forming Readily Disengageable Anti-Reverse Sealless Strap Connection," Ser. No. 934,497.

The present invention also relates to straps for baling material adapted for forming a sealless strap connection between overlapping strap ends which have an easily or readily disengageable anti-reverse structure that prevents the strap connection from accidentally disengaging but yet permits the strap loop to be readily and manually disconnected when desired. Various types of sealless strap connections with anti-reverse features (disengageable and non-disengageable) are also described in the aforementioned Lems et al. application entitled "Strap For Forming Readily Disengageable Anti-Reverse Sealless Strap Connection," Ser. No. 934,497.

The method of binding material or bales according to the present invention is especially useful in the cotton industry. When cotton is gathered together after picking, it is formed into relatively low density bales having a certain size. These low density bales are usually tied or bound with metal strap and are subsequently shipped to another work station such as a field warehouse, where they are further compressed in a special high pressure compress to a relatively high density. In the National Cotton Council publication entitled, "A Universal Bale for Universal Benefits," the term usually applied in the cotton industry to a large, low density bale is "Gin Flat" and the Gin Flat bale has nominal dimensions of 55"×45"×28" and has a nominal density of about 12 pounds per cubic foot. The smaller, high density bale may be one of several sizes, with the two preferred standard sizes being designated (1) the "Compress Universal" bale having nominal dimensions of 57"-58"×24"-25"×20"-22" and a nominal density of 20-28 pounds per cubic foot and (2) the "Gin Universal" bale having nominal dimensions of 54"-55"×20-"-21"×25"-28" and a nominal density of 28-30 pounds per cubic foot.

Since the high density bales are, of course, smaller than the low density bales, any bale tie or strap which has been placed around the larger, low density bale will be too large when that bale has been further compressed to the smaller, high density bale. This requires a restrapping of the high density bale with shorter strap lengths.

Presently in the cotton industry, bale ties or strap are removed from the larger, low density bales, typically by severing the strap. New, shorter strap lengths must be then applied to the recompressed, smaller, high density bale. It would be desirable to provide a method for strapping the large bale and the recompressed, smaller bale by reusing the large strap from the larger, low density bale.

The possibility of increasing or decreasing the length of a strap for reuse has been recognized in the prior art. Straps having a continuous array of slits which may be shortened to any length are disclosed in the U.S. Pat. No. 3,177,538 to Timmerbeil. The use of a number of smaller straps to form a longer, composite strap is disclosed in the U.S. Pat. No. 3,235,924 to Timmerbeil.

A metal strap segment which is adapted for forming a first loop about material to be tied and for forming a sealless strap connection between overlapping strap ends is disclosed in the U.S. patent application of Meier, Ser. No. 689,075, now U.S. Pat. No. 4,080,689. A primary strap segment is provided with at least one integral smaller strap segment adapted for forming a second smaller loop and for forming a sealless strap connection between overlapping strap ends of the smaller segment when the smaller segment is severed from the larger segment. The remaining, severed portion or portions of the larger, primary strap segment are also adapted for being reconnected and forming a sealless strap connection between overlapping ends. These portions may be connected into a composite strap or a predetermined length and reused for strapping the bale.

In the cotton industry, one type of large, low density cotton bale is formed which has a generally right rectangular prism shape. The size and density of the bale are such that six straps or bale ties are typically looped around the bale at substantially equally spaced locations and their ends connected to hold the bale together. When this large, low density bale is subsequently recompressed to the smaller low density bale, the length of the bale remains the same or is slightly increased. However, the cross section of the bale is substantially reduced. Further, the degree of compression in the smaller bale is so high that six straps or bale ties are considered an inadequate number. Consequently, it is common for eight smaller straps or bale ties to be used on the small, high density bale.

It would be desirable to provide a method for (1) using a primary strap segment having (a) integral second and third reusable connectable strap segments with the dimensions of the primary and reusable strap segments being of a predetermined fixed value and (b) a means, integral with the strap, for designating the smaller, reusable strap segments on the larger, primary strap segment and for (2) permitting the reusable strap segments to be easily, manually separated from the larger primary strap segment. Further, it would be advantageous if the dimensions of the larger primary strap segment and the reusable strap segments within the larger primary strap segment were such that the larger primary strap segment could be used to initially bind, along with five other similar primary strap segments, a large, low density bale. Subsequently, upon recompression of the larger bale into the smaller, high density bale, the six strap loops could be disconnected and the reusable smaller strap segments could be manually separated from the larger primary straps. The dimensions of the third strap segment could be such that the six third strap segments could be individually looped around the smaller, high density bale to form six strap loops thereabout. The dimensions of the six second strap segments could be such that they could be connected together in two groups of three to form two composite straps for forming seventh and eighth strap loops about the smaller bale.

When the larger, lwo density bale is strapped, the bale is first compressed enough so that the large straps can be placed around the bale and connected. During this process, the loop formed by the large strap is typically spaced away from the surface of the bale in a number of places, including in the region of the overlapping strap ends where the connection is being made. After the connection has been made, the bale is allowed to expand into contact with the loop. During the making of the connection in the strap loop around the bale, it is possible that the connection may become disengaged before the baled material is allowed to expand into contact with the loop to put tension on the strap. Consequently, it would be beneficial to provide an easily disengageable sealless strap connection with an anti-disengagement structure that would inhibit or reduced the possibility of disengagement of the connection until the bale compression was relieved and the material expanded tight against the strap loop.

Further, it would be advantageous to provide a sealless connection with an anti-reverse structure which would be easily disengaged by hand when it is desired to recompress the larger, low density bale and to remove the larger straps from the bale.

SUMMARY OF THE INVENTION

A method is provided for strapping a large, low density bale with a plurality of primary straps, each strap having the same predetermined length. The primary straps have joint elements on each end which are adapted for forming a sealless connection therebetween when the strap is formed in a loop about the large, low density bale.

According to one form of the method of the present invention, a large, low density bale is strapped with six such primary straps. When desired, the large, low density bale is recompressed and the six primary straps are disconnected in the manner described above. Subsequently, each of the six primary straps is broken or separated into two smaller strap segments for reuse about the smaller, high density bale produced by recompression of the original, larger, low density bale. To this end, each primary strap segment is provided with, in addition to the first and second joint-forming portions on each end, at least a third and fourth joint-forming portion lying between the first and second joint-forming portions. The third and fourth joint-forming portions contain an array of longitudinally spaced joint elements similar to the first and second joint-forming portions.

The strap further has at least one strap severance index located between the fourth and fifth joint-forming portions. The fourth joint-forming portion is spaced from the second joint-forming portion and is located adjacent the strap severance index. The forth joint-forming portion and the second joint-forming portion include and define a second strap segment on the bale tie primary strap. The first and third joint-forming portions include and define a third strap segment on the bale tie primary strap. The joint elements on the fourth joint-forming portion are adapted to interlock with the joint elements on the second joint-forming portion and the joint elements on the third joint-forming portion are adapted to interlock with the joint elements on the first joint-forming portion.

When the six primary straps have been disconnected and removed from the bale, each strap is broken at the severance index to separate the second and third strap segments. Next, three of the second strap segments are connected together by forming sealless strap connections between the interlocking joint elements of the fourth joint-forming portions and the second joint-forming portions which are now on the distal ends of the second strap segments. In this manner, a composite strap is formed which is substantially equal in length to the third strap segment. Two sets of three second strap segments from the six total second strap segments are put together in this manner to form two such composite straps. The two composite straps are each formed in a loop about the smaller, high density bale and a sealless connection is formed in the composite strap between the joint elements of the joint-forming portions on each distal end of the composite strap.

Next, the six remaining third strap segments are formed into six loops about the smaller, high density bale and a sealless connection is formed in each of the third strap segment loops between the joint elements of the first and third joint-forming portions on the ends of each third segment.

Lastly, the smaller, high density bale is allowed to expand into contact with the eight loops placed thereabout.

In use according to the above-described method of the present invention, the strap can be considered as having an inner side adapted to lie against the bale and an outer side opposite the inner side. A first readily disengageable anti-reverse bale tie engaging tab or abutment is located on the inner side of the strap and projects outwardly therefrom adjacent, but inwardly of, the first joint-forming portion. An engaging means or second readily disengageable anti-reverse bale tie engaging tab is located on the outer side of the strap and projects outwardly therefrom adjacent the second joint-forming portion between the second joint-forming portion and the distal end of the strap.

Additionally, another engaging means or third readily disengageable anti-reverse bale tie engaging tab may be located on the outer side of the strap and project outwardly therefrom between the third joint-forming portion and the strap severance index. Also, another abutment or fourth readily disengageable anti-reverse bale tie engaging tab may be located on the inner side of the strap to project inwardly therefrom adjacent the fourth joint-forming portion.

When a segment is first loosely looped and connected around the compressed material, the strap loop becomes outwardly bowed. According to the present invention, the outwardly bowed configuration of the strap loop is advantageously used to inhibit or reduce the possibility of disengagement of the connection until the compression on the bale can be relieved and the material allowed to expand tight against the strap loop. The curved or outwardly bowed configuration of the strap loop around the material also allows the loop to be easily disengaged by particular manipulation of the material and loop.

Specifically, when the loop is in the outwardly bowed configuration, the abutment tab is forced outwardly against the inner side of the other overlapping end of the strap. The engaging means tab, which projects outwardly from the inside surface of the strap just inwardly of the joint-forming portion of the overlapping strap end, is then in proper orientation to subsequently bear against the abutment and prevent the two ends of the strap from being moved relative to each other in a disengaging direction.

Should it be desired to engage the sealless strap connection, the compressible bale is further compressed to relieve strap tension and to provide space between the joint and the surface of the strap material. Then, by proper manipulation of the overlapping ends of the strap in the joint region, the strap can be bowed inwardly at that region. The distal end of the inner strap end (the end adjacent the bale and laying between the bale and the outer, overlapping strap end) is thus forced inwardly away from the engaging means and is free to then be moved past the engaging means in the disengaging direction to completely disconnect the joint.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
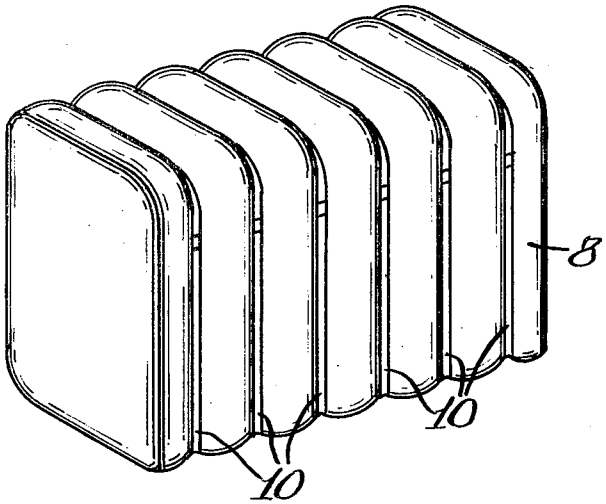
FIG. 1 is a perspective view of a large, low density bale of material bound with six bale ties or primary straps in accordance with the method of the present invention.

While the method according to the present invention is susceptible of embodiment in many different forms, there is shown in the drawings and will herein be described in detail one specific embodiment of the method, with the understanding that the present disclosure is to be considered as an exemplification of the principles of the invention and is not intended to limit the invention to the one embodiment illustrated.

FIG. 1 shows a bale of compressible material such as cotton formed into a bale 8 and tied or bound with a plurality of primary metal straps or bale ties 10. The bale 8 illustrated in FIG. 1 is, for purposes of discussion, assumed to be a large, low density bale which is initially baled or formed in the field at a cotton gin. Typically, six bale ties 10 are used around such a large bale 8. Each strap 10 is overlapped at its ends and may be connected by means of crimped seal connections or interlocking joint elements on each of the overlapping ends. The interlocking joint elements form the so-called "sealless connections" and may be of many types, including some of those described in the patents discussed in the section entitled "Background of the Invention."

Figure 2:
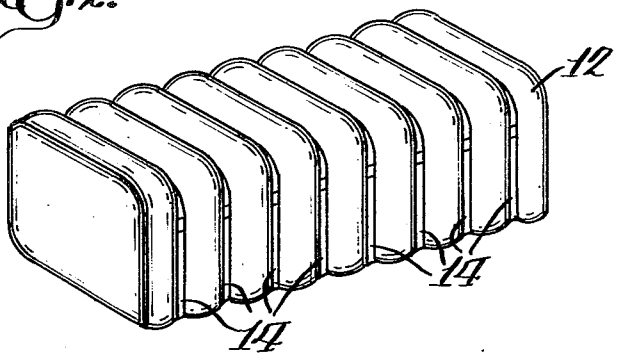
FIG. 2 is a perspective view of the bale shown in FIG. 1 compressed to a much higher density and smaller physical size having eight smaller strap segments banded about it according to the method of the present invention.

The large, low density bales, such as bale 8, are shipped from the field to a warehouse for further compression and for being formed into bales of a higher density and smaller physical size. Such a bale 12 is illustrated in FIG. 2. In order to form this smaller bale 12, the strap 10 must be removed from the larger bale 8. This may be done by cutting each of the straps 10 or, if a disengageable sealless connection is used on a strap 10, by manually disengaging such connections.

Manual disengagement of sealless strap connections can be accomplished only if the larger bale 8 is first placed in a "dinky" press and further compressed to provide slack in the straps 10 so that the connections may be easily manually disengaged. Next, the larger bale 8 is placed in a final press to form the smaller bale 12.

New, smaller straps 14 may be connected around the bale 12 to maintain the configuration of the bale. However, since the compression of the smaller bale 12 is much greater than that existing in the larger bale 8, more straps are used to tie the smaller bale. Typically, eight small straps 14 would be used about the small bale 12 as compared to six straps 10 for the larger bale 8.

In order to avoid having to cut the straps 10 from the larger bale 8, the present invention provides a novel method for using anti-reverse sealless strap connections which may be easily disengaged manually. However, with easily disengageable strap connections, certain problems arise.

For example, during the initial encircling of the bale with the strap and during the initial forming of the connection between the overlapping strap ends, there is a tendency for the connection to disengage until the bale is allowed to partially expand tightly against the strap loop. Thus, extra care must be taken to maintain the overlapping strap ends in proper alignment until the bale is allowed to expand against the loop whereby the overlapping strap ends are pulled tight to form a good joint.

A strap connection structure and method for using such a structure is provided according to the present invention which inhibits or reduces the possibility of disengagement of the connection until the bale press compression can be relieved and the material expanded tight against the loop. Further, the strap connection can be easily manually disengaged when so desired by recompression of the bale.

In order to avoid having to discard the used, larger strap 10 removed from the large, low density bale 8, the present invention provides a method for reusing the straps to form smaller strap segments of the exact length needed to bind a smaller, high density bale (such as bale 12 illustrated in FIG. 2).

Figure 3:
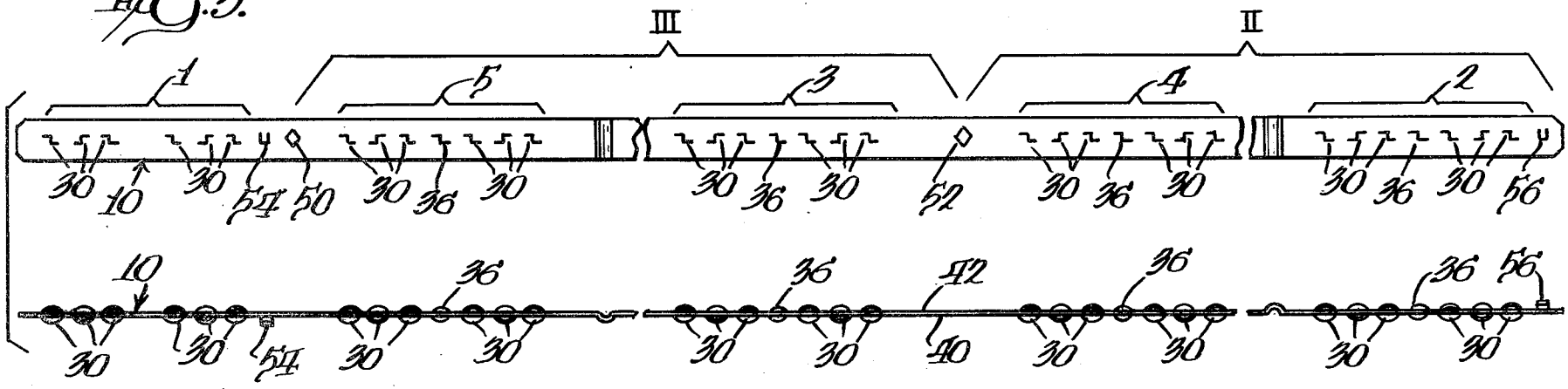
FIG. 3 is a plan view and corresponding side view of a primary strap segment showing five arrays of longitudinally spaced joint elements, two strap severance indicia, and two anti-reverse tabs.
Figure 5:
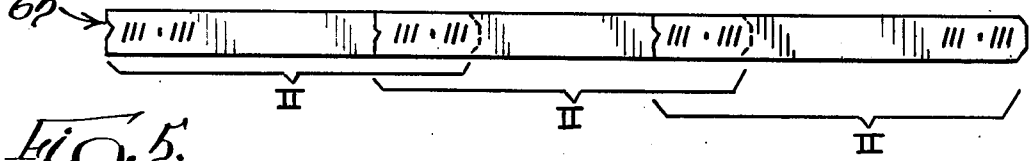
FIG. 5 is a diagrammatic end view showing the formation of the larger, low density bale of FIG. 1 by a bale press with a primary strap being looped and connected thereabout just prior to releasing the bale press.

A bale tie or strap 10 for use according to the method of the present invention is illustrated in FIG. 3. Strap 10 has an inner side 40 adapted to lie against a bale to be tied and an outer side 42 opposite the inner side. The strap 10 has a first joint-forming portion indicated by bracket 1 on one end and a second joint-forming portion indicated by bracket 2 on the other end. The joint-forming portions each contain an array of longitudinally spaced joint elements. FIG. 5 is a diagrammatic illustration of the strap 10 being placed in a connected loop about the larger, low density bale 8, as it is being formed in a press 9, with the inner side of the strap 40 facing the bale and with second joint-forming portion 2 lying between the bale and the first joint-forming portion 1. The individual joint elements, designated 30, are indicated by slanted lines for simplicity.

Preferably, there are six joint elements in each array on each joint-forming portion, those elements being designated by numeral 30. The joint elements are formed by longitudinally oriented, spaced, staggered slits defining and being flanked by complimentary integral web portions of strap offset in opposite normal directions to present lengthwise opposed shoulders which interlock with opposed shoulders of an overlapping strap segment end. Such a joint element structure is disclosed in the U.S. Pat. No. 3,303,541 to Beach and attention is directed thereto.

The second joint-forming portion preferably has an anti-disengagement or anti-reverse protuberance, such as shoulder 36, the purpose of which will be explained hereinafter, but which is an outwardly projecting shoulder displaced from the plane of the strap. When a joint-forming portion containing such a shoulder 36 is overlapped and interlocked with the joint-forming portion of a strap having a similar, but oppositely facing anti-disengagement shoulder, the shoulders irreversibly override each other as the joint elements interlock and present opposed stops to prevent disengagement of the connection. That is, the anti-reverse shoulders 36 are not readily or easily disengageable. Such an anti-disengagement shoulder construction is disclosed in the U.S. Pat. No. 3,935,616 to Simmons.

As illustrated in FIGS. 3 and 5, the primary strap 10 further has a third joint-forming portion indicated by bracket 3 and a fourth joint-forming portion indicated by bracket 4 lying between the first and second joint-forming portions (brackets 1 and 2). Further, a fifth joint-forming portion indicated by bracket 5 lies between the first and third joint-forming portions. As with the first and second joint-forming portions, the third, fourth and fifth joint-forming portions also contain arrays of longitudinally spaced joint elements of the same configuration. The third, fourth, and fifth joint-forming portions also have an anti-disengagement shoulder, similar to shoulder 36 described above with reference to the second joint-forming portion designated by bracket 2.

The bale tie primary strap 10 also has a first strap severance index, such as the diamond shaped aperture 50, located between the first and fifth joint-forming portions and a second strap severance index, such as diamond shaped aperture 52, located between the third and fourth joint-forming portions. The strap severance indicia 50 and 52 are essentially diamond shaped apertures extending across some portion of the width of the strap and serve as a designation of where the strap is to be manually bent so as to fracture and sever the strap at that point.

With reference to FIG. 3, it is seen that the fourth joint-forming portion is spaced from the second joint-forming portion. A second strap segment, indicated by bracket II, is thus defined by the second and fourth joint-forming portions on the strap. The third and fifth joint-forming portions are spaced apart to include and define a third strap segment, indicated by bracket III, on the strap.

The second strap severance index 52 lies in the strap between the second and third strap segments II and III, respectively, and serves to indicate that the strap may be broken at that point to separate the second and third strap segments. On the other end of the strap, the strap severance index 50 indicates that the first joint-forming portion marked by bracket I, may be severed at the index 50 from the rest of the strap 10, including the immediately adjacent third strap segment indicated by bracket III.

The joint elements on the fourth joint-forming portion are adapted to interlock with the joint elements on the second joint-forming portion and the joint elements on the third joint-forming portion are adapted to interlock with the point elements on the fifth joint-forming portion. The use of this interlocking feature will be explained hereinafter.

There are two readily disengageable anti-reverse bale tie engaging tabs located on the strap 10. These are designated as 54 and 56 in FIG. 3. The first anti-reverse tab 54 is located on the first joint-forming portion projecting outwardly from the inner side 40 of the strap adjacent the first severance index 50. The second anti-reverse tab 56 is located on the second joint-forming portion projecting outwardly from the outer side 42 of the strap adjacent the distal end of the strap. Each tab 54 and 56 is a generally outwardly projecting, square-shaped piece of strap metal which has three sides defined by a slit and a fourth side merging with the plane of the strap. Preferably, the tabs are oppositely facing as illustrated.

The tabs 54 and 56 are preferably punched from the plane of the strap during fabrication of the strap. The tab 54 is associated with the inner side 40 of the strap for engaging the tab 56 of the second joint-forming portion 2 to prevent disengagement of the sealless strap connection when the strap loop is placed around a bale of compressed material. As the loop is placed about the bale 8 and as the ends of the strap are connected, as in FIG. 5, the loop becomes bowed outwardly from the bale to force the tab 56 against the inner side 40 of the first joint-forming portion 1 and in alignment with the tab 54. Depending on the particular design and/or joint element tolerances, the tabs 54 and 56 may be in contact or may be slightly spaced apart. In any case, the strap joint becomes bowed so that both tabs 54 and 56 are in alignment whereby the tabs will abut if and when the joint-formed portions are moved in a joint disengaging direction. In this way, the second anti-reverse bale tie engaging tab 56 is always biased into alignment with the first tab 54 even though the remaining length of the first joint-forming portion 1 may be spaced outwardly from the second joint-forming portion 2. In order that the engaging tab 54 can be properly aligned and subsequently engaged by the tab 56, the tab 54 is located, with respect to the distal end of the first joint-forming portion 1, inwardly of, and adjacent the array of longitudinally spaced joint elements.

The above-described anti-reverse bale tie engaging structure is also disclosed in the concurrently filed application of Lems et al. entitled "Strap For Forming A Readily Disengageable Anti-Reverse Sealless Strap Connection," Ser. No. 934,497 and attention is directed thereto.

According to the method of the present invention, the larger, low density bale is strapped with a plurality, preferably six, of large primary straps 10 as illustrated in FIG. 1. The sealless connections are made between the overlapping end portions and the connections are resistant to accidental disengagement by virtue of the disengageable anti-reverse tabs 54 and 56 incorporated within the strap. When it is desired to remove the straps 10 from the larger bale 8, the bale is further compressed, as in a bale press, and each strap becomes outwardly bowed with respect to portions of the bale surface. By suitable positioning of the bale within the press, the joint area of each strap loop can be maintained out of contact with, and away from, the bale surface. This is diagrammatically illustrated in FIG. 6 where the compression of the bale is achieved by applying pressure with a bale press (not illustrated, but similar to press 9 in FIG. 5). Compression of the bale may be accomplished by a suitable bale press.

Figure 6:
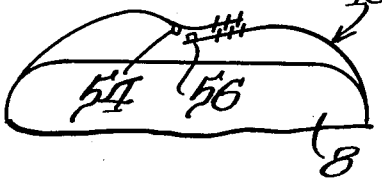
FIG. 6 is a diagrammatic, fragmentary cross-sectional end view of the bale of FIG. 5 illustrating how the strap loop may be deformed to effect disengagement of the connection.

In order to disengage the connection between the joint-forming portions 1 and 2, the part of the strap loop containing the joint-forming portions is moved inwardly towards the compressed bale surface to reverse the outwardly bowed loop to an inwardly bowed loop in the region of the sealless connection as illustrated in FIG. 6. This causes the distal end of the strap at the second joint-forming portion to be forced inwardly towards the bale, carrying with it the tab 56. In this manner, the tabs 54 and 56 are moved out of alignment and separated.

After the tabs 54 and 56 are separated, the joint can be disconnected by displacing one of the first and second joint-forming portions longitudinally relative to the other portion in a joint disengaging direction.

It should be noted that the first joint-forming portion 1 does not have an anti-reverse shoulder, such as shoulder 36 on the second joint-forming portion 2 (FIG. 3). Thus, when these portions are connected, the shoulder 36 on the second joint-forming portion 2 lies against a flat strap region on the first joint-forming portion 1 and cannot form any kind of interlock. However, shoulder 36 on the second joint-forming portion 2 can be used later when the strap is reused to bind a smaller bale as will be explained hereinafter.

After the six primary straps 10 have been removed from the large bale 8, each strap is then bent manually at the strap severance indicia 50 and 52 to cause the strap to break in two places yielding the separated second strap segment (bracket II), the separated third strap segment (bracket III), and a small portion of strap containing the first joint-forming portion 1. The first joint-forming portion of the strap is discarded and the second and third strap segments are reused as next explained.

Figure 4:
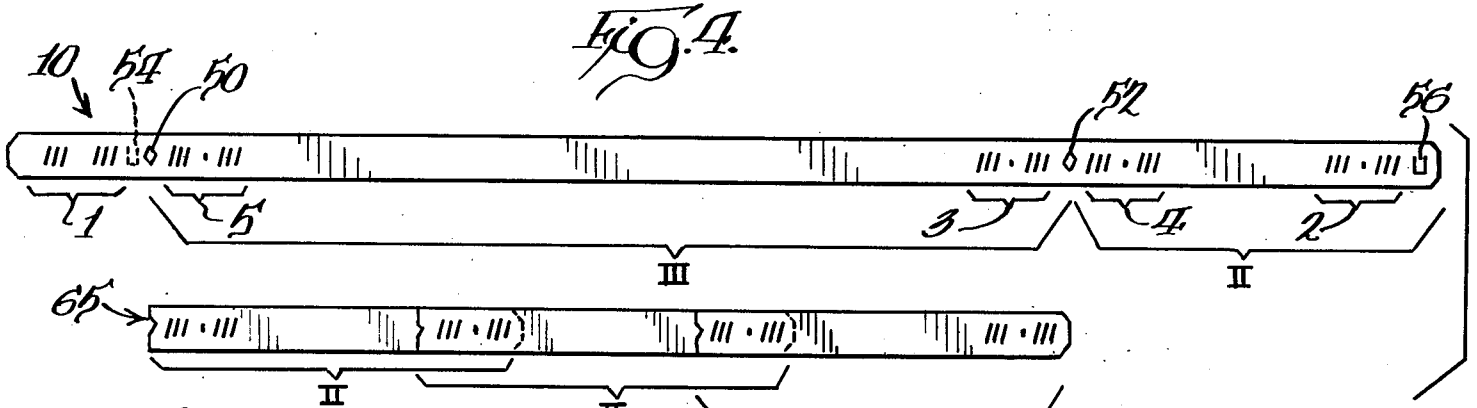
FIG. 4 is a diagrammatic plan view of the primary strap illustrated in FIG. 3 and of a composite strap aligned therewith to show an internal portion of the primary strap being equal in length to the composite strap.

The second strap segments may be interconnected and preferably, three of the six second strap segments are connected together to form a composite strap. Since there are six second strap segments which result from the severance of the six primary straps, two composite straps, consisting of three second strap segments each, can be formed from the six second strap segments. The connection between the second strap segments is made by interlocking a fourth joint-forming portion on one second strap segment with a second joint-forming portion on another second strap segment. When the three second strap segments are connected together, they form a composite strap 65 having a length, illustrated in FIG. 4, which is equal to the length of the third strap segment (bracket III) of the primary strap 10.

Figure 7:
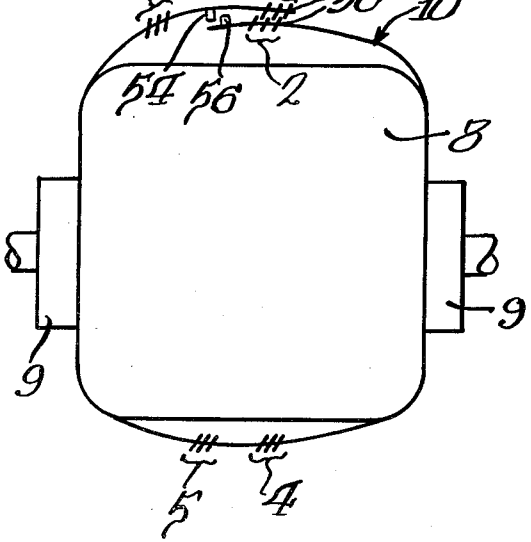
FIG. 7 is a diagrammatic perspective view of the smaller, high density bale shown in FIG. 2 with two composite straps looped thereabout.
Figure 7:
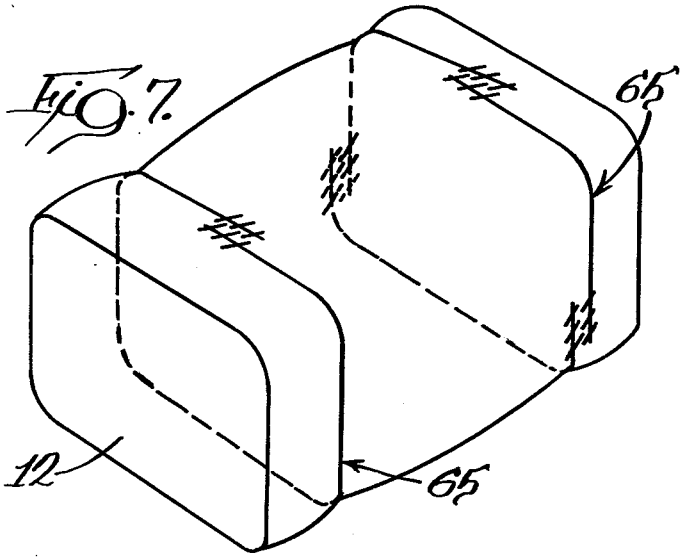

Next, a loop can be formed about a compressed second bale, which is smaller than the first bale, with the two composite straps as illustrated in FIG. 7. A sealless connection is formed in the composite strap 65 between the joint elements of the joint-forming portions on each end of the composite strap.

Similarly, the six third strap segments can be formed into six loops about the second smaller bale and a sealless connection formed in each of the third strap segment loops between the joint elements of the third and fifth joint-forming portions on each third strap segment. After all of the loops are in place, the bale press can be released to allow the bale to expand into contact with the eight loops to form the bale substantially as illustrated in FIG. 2.

If the shoulders 36 are provided in the second, third, fourth and fifth joint-forming portions as illustrated, the sealless connection formed between the overlapping ends of the third strap segments III and between the overlapping ends of the second strap segments II will not be readily disengageable and thus will not be accidentially opened during further handling of the bales.

It is not necessary that the second strap segment II be reused. If desired, the second strap segment can be discarded and all baling of the smaller size bales can be done with the third strap segments III. If this were the case, the primary strap 10 need not be manufactured with the fourth joint-forming portion 4.

Instead of separating the strap 10 at the strap severance indicia 50 and 52, the same large strap could be reused to tie new, large bales 8. If this were the case, it would obviously not be necessary for the strap 10 to have the third, fourth or fifth joint-forming portions incorporated thereon.

The location of the fourth and fifth joint-forming portions on the strap 10 and the location of the strap severance index 52 can be varied, of course, during manufacture of the strap 10 to provide the appropriate length second and third strap segments for the particular bale sizes with which the strap is intended to be used.

Additionally, instead of combining three second strap segments II together, only two strap segments II could be combined together to form a composite strap and such a composite strap, though shorter, might be used to strap a second, but much smaller, bale. Further, instead of combining three or two second strap segments together to form a composite strap, just one second strap segment could be used to strap a recompressed bale, providing the bale was small enough compared to the length of the second strap segment.

Figure 8:
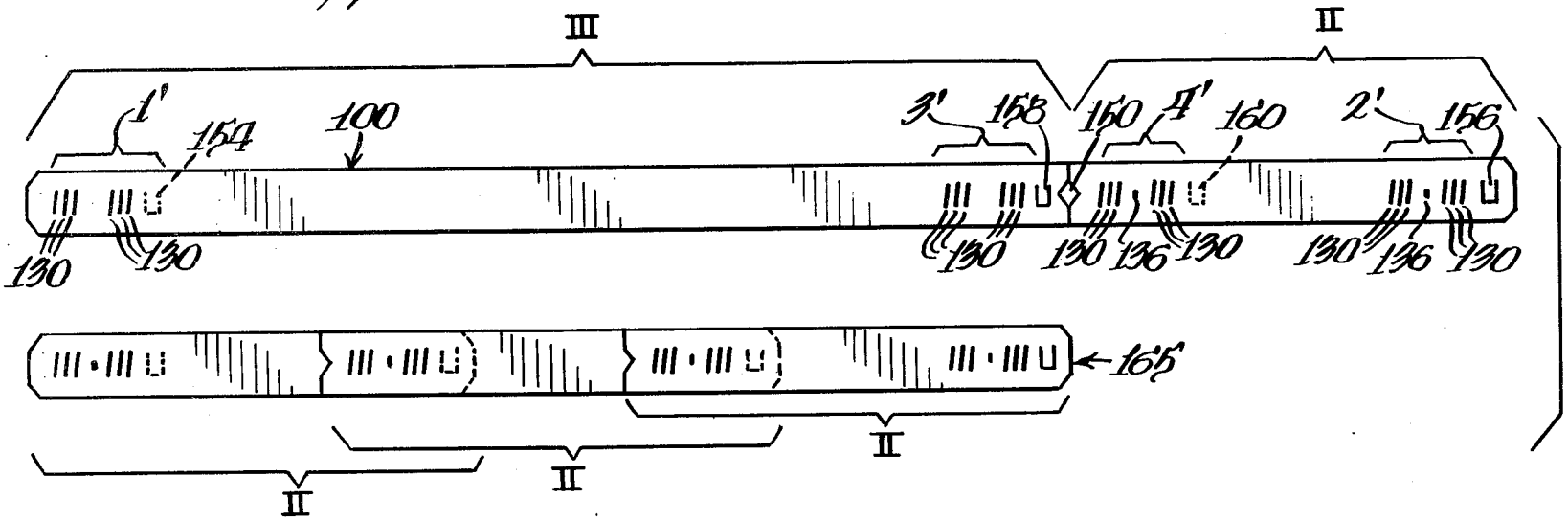
FIG. 8 is a diagrammatic plan view, similar to FIG. 4, but showing another embodiment of the primary strap of the present invention in relation to a composite strap formed from segments of the primary strap.

Another embodiment of the strap for use according to the method of the present invention is designated 100 in FIG. 8 which shows the strap diagrammatically in plan view. The strap 100 has a first joint-forming portion 1' on one end and a second joint-forming portion 2' on the other end. The joint-forming portions each contain an array of longitudinally spaced joint elements, such as those described above for the first embodiment of the primary strap 10 and illustrated in FIG. 3. Specifically, the first joint-forming portion 1' may have six individual joint elements 130 similar to elements 30 illustrated in FIG. 3, and the second joint-forming portion 2' may have a similar set of joint elements 130. The second joint-forming portion may also have an anti-reverse shoulder 136 which is similar to shoulder 36 described above for the first embodiment of the primary strap 10 (illustrated in FIG. 3) and which is not readily disengageable with respect to a similar, but oppositely oriented shoulder on another joint-forming portion of a strap.

The primary strap 100 further has a third joint-forming portion 3' and a fourth joint-forming portion 4' lying between the first and second joint-forming portions 1' and 2'. As with the first and second joint-forming portions, the third and fourth joint-forming portions also contain arrays of longitudinally spaced joint elements 130. The fourth joint-forming portion may also have an anti-reverse shoulder 136 which is not readily disengageable from a similar, but oppositely oriented shoulder on another joint-forming portion of a strap.

The primary strap 100 further has a single strap severance index 150, such as a diamond-shaped aperture, located between the third and fourth joint-forming portions. The strap severance index 150 is identical to the strap severance indicia 50 or 52 described above with reference to the first embodiment of the primary strap 10 and illustrated in FIGS. 3 and 4.

With reference to FIG. 8, it is seen that the fourth joint-forming portion 4' is spaced from the second joint-forming portion 2' to define a second strap segment indicated by bracket II. Similarly, the first and third joint-forming portion 1' and 3' define a third strap segment indicated by bracket III.

The strap severance index 150 lies in the strap between the third and fourth joint-forming portions (and hence between the second and third strap segments II and III), and indicates that the strap may be broken or severed at that point to separate the second and third strap segments. The joint elements 130 on the third joint-forming portion 3' are adapted to interlock with the joint elements 130 on the first joint-forming portion 4' and the joint elements 130 on the fourth joint-forming portion are adapted to interlock with the joint elements 130 on the second joint-forming portion 2' when the strap is severed at the strap severance index 150.

There are four disengageable anti-reverse bale tie engaging tabs 154, 156, 158, and 160 located on the strap 100. The anti-reverse tabs 154 and 156 are identical in orientation, location and structure to the tabs 54 and 56 described above with reference to the first embodiment of the primary strap 10 and illustrated in FIG. 3. Similarly, the tabs 158 and 160 have the same general structure as the tabs 154 and 156. Tab 158, being located on the third strap segment III, is on the opposite side of the strap from the tab 154. Tab 160, being located on the second strap segment II, is on the opposite side of the strap from tab 156.

Tabs 154 and 156 function in the same manner as tabs 54 and 56 described above with reference to the first embodiment of the primary strap 10. That is, when the primary strap 100 is looped around a bale and when the first and second joint-forming portions 1' and 2', respectively, are connected, the tabs 154 and 156 bear against each other to prevent the connection from accidentally becoming disengaged.

According to the method of the present invention, the primary strap 100 can be used in basically the same manner as the primary strap 10 described above. The basic difference is that the primary strap 100 does not have the extra portion of material comprising the first joint-forming portion 1 illustrated in FIG. 4 which must be discarded.

A plurality of straps 100, preferably six, are used to strap a large, low density bale. When the large bale is further compressed to the smaller, low density bale, the six primary straps 100 may be removed by disengaging the individual connections in the same manner as explained above with reference to the primary strap 10 illustrated in FIGS. 3 through 6. Subsequently, the six straps are severed at the strap severance index 150 to create the second and third strap segments, II and III, respectively. As illustrated in FIG. 8, three of the secondary strap segments II can be connected end-to-end to form a composite strap 165. Two such composite straps can be formed from the six secondary strap segments II which are severed from the six primary strap segments 100.

As illustrated in FIG. 8, the composite strap segment 165 which is formed from three of the secondary strap segments II has a length which is equal to the length of the third strap segment III. Thus, it is possible to make, from six primary strap segments 100, eight smaller straps of equal length: six third strap segments III and two composite strap segments 165 formed from the secondary strap segments II. These eight straps can be used to bind the smaller, high density bale.

When the smaller, high density bale is bound with the two composite strap segments 165 and with the six third strap segments III, it is seen that the additional readily disengageable anti-reverse bale tie engaging tabs 154, 156, 158, and 160 can cooperate to reduce the possibility of the various joints becoming disengaged.

As has been described above with respect to the first embodiment of the primary strap 10 illustrated in FIGS. 3 through 6, the easily disengageable anti-reverse bale tie engaging tabs 154 and 156 function to prevent disengagement when the strap loop is in an outwardly bowed configuration. The tabs can be disengaged, however, when the strap loop is moved from the outwardly bowed configuration to an inwardly bowed configuration. Thus, when a strap containing a connection having a pair of easily disengageable tabs is not maintained in an outwardly bowed configuration, the anti-reverse feature cannot always be relied upon to prevent the connection from disengaging. Hence, when the composite strap 165 is being initially formed from a plurality of smaller strap segments II, the strap segment connections may tend to disengage unless and until the composite strap segment 165 is looped around the bale and formed into an outwardly bowed configuration.

In order to reduce the possibility of disengagement of the connections of the strap segments making up the composite strap segment 165, the anti-reverse shoulder 136 (disclosed in the above-discussed U.S. Pat. No. 3,935,616) may be used in certain of the joint element arrays (joint-forming portions 2' and 4', for example) as illustrated in FIG. 8. Use of this type of anti-reverse protuberance 136 prevents the second strap segments II from being easily or readily manually disengaged. Consequently, once a loop of a composite strap segment 165 having such non-removable anti-reverse shoulder 136 is connected around a bale, the strap loop must be severed to subsequently remove it from the bale. However, this is typically not a problem since the composite strap 165 is intended for use on the smaller, high density bale and when it is desired to remove the composite strap 165 from the smaller, high density bale, the bale has typically reached its end use destination and there are no further requirements for re-strapping that bale or any other bale at the end use point. Thus, there is typically no need to reuse the composite straps 165 at the end use destination.

Instead of using an anti-reverse shoulder 136 of the type described above and disclosed in the U.S. Pat. No. 3,935,616, it may be desirable in some instances to join the second strap segments II together to form a composite strap 165 with the joint-forming portions 2' and 4' having just six joint elements 130 each and to then notch or crimp the strap with a special tool at each joint region to make a permanent connection which is not readily disengaged.

From the foregoing, it will be observed that numerous variations and modifications may be effected without departing from the true spirit and scope of the novel concept of the invention. It is to be understood that no limitation with respect to the specific method illustrated herein is intended or should be inferred. It is, of course, intended to cover by the appended claims all such modifications as fall within the scope of the claims.

What is claimed is:

1. The method of using a bale tie primary strap for binding a first bale and for reusing a segment of the primary strap for binding a second, smaller bale, said method comprising the steps of:

(a) providing a bale tie primary strap adapted for forming a primary loop about said first bale and having a plurality of arrays of longitudinally spaced joint elements including an array on each end of the primary strap comprising first and second joint-forming portions, each said array being adapted to interlock with at least one other array, two of said arrays including and defining at least one secondary strap segment shorter than said primary strap, said primary strap further including at least one strap severance index, said primary strap further including first and second anti-reverse bale tie engaging tabs on said first and second joint-forming portions, respectively;

(b) forming said primary strap into an outwardly bowed loop about said first bale with said second joint-forming portion overlapped by said first joint-forming portion;

(c) forming a sealless strap connection in the loop with the distal end of said second joint-forming portion being baised outwardly against said first joint-forming portion whereby said second tab is aligned with said first tab to prevent disengagement of the connection when the strap is in the outwardly bowed position;

(d) compressing said first bale to (1) move a portion of said bale surface out of contact with, and away from, said primary strap at said sealless connection between said first and said second joint-forming portions and (2) create slack in said loop;

(e) moving the region of the strap loop containing said sealless connection inwardly towards said compressed bale surface to reverse the outwardly bowed loop to an inwardly bowed loop in the region of said sealless connection whereby the distal end of said strap at said second joint-forming portion and said second tab thereon is moved inwardly and away from said first tab on said first joint-forming portion;

(f) displacing one of said first and second joint-forming portions longitudinally relative to the other portion in a disengaging direction to disengage said sealless connection;

(g) breaking said primary strap at at least one said severance index to separate said secondary strap segment from the remainder of said primary strap;

(h) forming a smaller loop about a compressed second bale smaller than said first bale with said secondary strap segment and forming a sealless connection in said secondary strap segment between two of said arrays on each end of said secondary strap segment; and (i) releasing compression to allow said second bale to expand into contact with said smaller loop.

2. The method of using a plurality of bale tie primary straps for binding a first bale and for reusing segments of the straps for binding a second, smaller bale, said method comprising the steps of:

(a) providing a plurality of bale tie primary straps, each of said straps adapted for forming a primary loop about said first bale and having four arrays of longitudinally spaced joint elements including an array on each end of the primary strap comprising first and second joint-forming portions, each of said four arrays being adapted to interlock with at least one other array, the two arrays interior of said first and second joint-forming portions including and defining, in cooperation with the arrays on said first and second joint-forming portions, second and third strap segments on said primary strap, said primary strap further including a strap severance index between said third joint-forming portion and said fourth joint-forming portion, said primary strap further including first and second anti-reverse bale tie engaging tabs on at least said first and second joint-forming portions, respectively;

(b) forming each of said primary straps into an outwardly bowed loop about said first bale with said second joint-forming portion overlapped by said first joint-forming portion;

(c) forming a sealless strap connection in the loop with the distal end of said second joint-forming portion being biased outwardly against said first joint-forming portion whereby said second tab is aligned with said first tab to prevent disengagement of the connection when the strap is in the outwardly bowed position;

(d) compressing said first bale to (1) move a portion of said bale surface out of contact with, and away from, each said primary strap at said sealless connection between said first and said second joint-forming portions and (2) create slack in said loops;

(e) moving the region of each strap loop containing said sealless connection inwardly towards said compressed bale surface to reverse the outwardly bowed loop to an inwardly bowed loop in the region of said sealless connection whereby the distal end of said strap at said second joint-forming portion and said second tab thereon is moved inwardly and away from said first tab on said first joint-forming portion;

(f) displacing one of said first and second joint-forming portions longitudinally relative to the other portion in a disengaging direction to disengage said sealless connection of each strap loop;

(g) breaking said primary straps at said severance index to separate said second and third strap segments;

(h) connecting said second strap segment severed from a primary strap with at least one other similar second strap segment from another primary strap by forming at least one sealless strap connection between one of said arrays on one second strap segment and one of said arrays on the other second strap segment to form at least one composite strap substantially equal in length to said third strap segment;

(i) forming at least one first smaller loop about a compressed second bale smaller than said first bale with one of said remaining third strap segments and forming a sealless connection in said third strap segment between two of said arrays on each end of said third strap segment;

(j) forming at least one second smaller loop about said smaller bale with said composite strap and forming a sealless connection in said composite strap between two of said arrays on each end of said composite strap; and (k) releasing compression to allow said second bale to expand into contact with said first and second smaller loops.

3. The method of using a plurality of bale tie primary straps for binding a first bale and for reusing segments of the straps for binding a second, smaller bale, said method comprising the steps of:

(a) providing a plurality of bale tie primary straps, each of said straps adapted for forming a primary loop about said first bale and having a first joint-forming portion on one end and a second joint-forming portion on the other end, said joint-forming portions each containing an array of longitudinally spaced joint elements, said joint elements on one of said portions being adapted to interlock with the joint elements on the other portion for forming a sealless strap connection when the joint-forming portions are overlapped with said second joint-forming portion lying between said first bale and said first joint-forming portion, each said strap further having an inner side adapted to lie against said first bale and an outer side opposite the inner side, each said strap further having a third and fourth joint-forming portion lying between said first and second joint-forming portions, said third and fourth joint-forming portions each containing an array of longitudinally spaced joint elements, said strap further having a strap severance index located between said third and fourth joint-forming portions, said fourth joint-forming portion spaced from said second joint-forming portion and located adjacent said first strap severance index, said fourth joint-forming portion and said second joint-forming portion including and defining a second strap segment on said bale tie primary strap, said first and third joint-forming portions including and defining a third strap segment on said bale tie primary strap, the joint elements on said fourth joint-forming portion being adapted to interlock with the joint elements on said second joint-forming portion, the joint elements on said third joint-forming portion being adapted to interlock with the joint elements on said first joint-forming portion, said strap further including a first disengageable anti-reverse bale tie engaging tab located on said first joint-forming portion projecting outwardly from said inner side of said strap and adjacent said first strap severance index, said strap further including a second disengageable anti-reverse bale tie engaging tab located on said second joint-forming portion projection outwardly from said outer side of said strap and adjacent the distal end of said strap;

(b) forming each of said primary straps into an outwardly bowed loop about said first bale with said inner side facing towards the surface of said first bale;

(c) interlocking said joint elements of said first and second joint-forming portions to form a sealless strap connection in the loop with the distal end of said second joint-forming portion being biased outwardly against the inner side of said first joint-forming portion whereby said second tab is aligned with said first tab to prevent disengagement of the connection when the strap is in the outwardly bowed position;

(d) compressing said first bale to (1) move a portion of said bale surface out of contact with, and away from, said inner side of each said primary strap at said sealless connection between said first and said second joint-forming portions and (2) create slack in said loops;

(e) moving the region of each strap loop containing said sealless connection inwardly towards said compressed bale surface to reverse the outwardly bowed loop to an inwardly bowed loop in the region of said sealless connection whereby the distal end of said strap at said second joint-forming portion and said second tab thereon is moved inwardly and away from said first tab on said first joint-forming portion;

(f) displacing one of said first and second joint-forming portions longitudinally relative to the other portion in a disengaging direction to disengage said sealless connection of each strap loop;

(g) breaking each said primary strap at said severance index to separate said second and third strap segments;

(h) connecting said second strap segment severed from a primary strap with at least one other similar second strap segment from another primary strap by forming a sealless strap connection between the interlocking joint elements of a fourth joint-forming portion on one second segment with a second joint-forming portion on the other second segment to form at least one composite strap substantially equal in length to said third strap segment;

(i) forming at least one first smaller loop about a compressed second bale smaller than said first bale with one of said remaining third strap segments and forming a sealless connection in said third strap segment between the joint elements of said first and third joint-forming portions;

(j) forming at least one second smaller loop about said smaller bale with said composite strap and forming a sealless connection in said composite strap between the joint elements of the joint-forming portions on each end of said composite strap; and (k) releasing compression to allow said second bale to expand into contact with said first and second smaller loops.

4. The method in accordance with claim 3 in which severance indicia are defined in said primary strap by diamond-shaped apertures and in which said step of breaking each primary strap includes bending the primary strap to fracture the strap at the severance indicia.

5. The method in accordance with claim 3 in which said primary strap further includes (1) a third disengageable anti-reverse bale tie engaging tab located on said third strap segment between said third joint-forming portion and said strap severance index, said third tab projecting outwardly from said outer side of said strap and (2) a fourth disengageable anti-reverse bale tie engaging tab located on said second strap segment inwardly of and adjacent said fourth joint-forming portion, said fourth tab projecting outwardly from said inner side of said strap and in which said step (j) includes interlocking a fourth joint-forming portion at one end of said composite strap with a second joint-forming portion at the other end of said composite strap with said second joint-forming portion being biased outwardly against the inner side of a fourth joint-forming portion whereby said fourth tab is aligned with said third tab to prevent disengagement of the connection when the strap is in the outwardly bowed position.

6. The method of using a plurality of bale tie primary straps for binding a first bale and for reusing segments of the straps for binding a second, smaller bale, said method comprising the steps of:

(a) providing a plurality of bale tie primary straps, each of said straps adapted for forming a primary loop about said first bale and having five arrays of longitudinally spaced joint elements including an array on each end of the primary strap comprising first and second joint-forming portions, each of said five arrays being adapted to interlock with at least one other array, the three arrays interior of said first and second joint-forming portions including and defining in cooperation with the array on said second joint-forming portion second and third strap segments on said primary strap, said primary strap further including a first strap severance index between said first joint-forming portion and said third strap segment and further including a second strap severance index between said second and third strap segments, said primary strap further including first and second anti-reverse bale tie engaging tabs on said first and second joint-forming portions, respectively:

(b) forming each of said primary straps into an outwardly bowed loop about said first bale with said second joint-forming portion overlapped by said first joint-forming portion;

(c) forming a sealless strap connection in the loop with the distal end of said second joint-forming portion being biased outwardly against said first joint-forming portion whereby said second tab is aligned with said first tab to prevent disengagement of the connection when the strap is in the outwardly bowed position;

(d) compressing said first bale to (1) move a portion of said bale surface out of contact with, and away from, each said primary strap at said sealless connection between said first and said second joint-forming portions and (2) create slack in said loops;

(e) moving the region of each strap loop containing said sealless connection outwardly towards said compressed bale surface to reverse the outwardly bowed loop to an inwardly bowed loop in the region of said sealless connection whereby the distal end of said strap at said second joint-forming portion and said second tab thereon is moved inwardly and away from said first tab on said first joint-forming portion;

(f) displacing one of said first and second joint-forming portions longitudinally relative to the other portion in a disengaging direction to disengage said sealless connection of each strap loop;

(g) breaking said primary straps at said first severance index and at said second severance index to separate said second and third strap segments and said first joint-forming portion;

(h) discarding said first joint-forming portion broken from each primary strap;

(i) connecting said second strap segment severed from a primary strap with at least one other similar second strap segment from another primary strap by forming at least one sealless strap connection between one of said arrays on one second strap segment and one of said arrays on the other second strap segment to form at least one composite strap substantially equal in length to said third strap segment;

(j) forming at least one first smaller loop about a compressed second bale smaller than said first bale with one of said remaining third strap segments and forming a sealless connection in said third strap segment between two of said arrays on each end of said third strap segment;

(k) forming at least one second smaller loop about said smaller bale with said composite strap and forming a sealless connection in said composite strap between two of said arrays on each end of said composite strap; and (l) releasing compression to allow said second bale to expand into contact with said first and second smaller loops.

7. The method of using a plurality of bale tie primary straps for binding a first bale and for reusing segments of the straps for binding a second, smaller bale, said method comprising the steps of:

(a) providing a plurality of bale tie primary straps, each of said straps adapted for forming a primary loop about said first bale and having a first joint-forming portion on one end and a second joint-forming portion on the other end, said joint-forming portions each containing an array of longitudinally spaced joint elements, said joint elements on one of said portions being adapted to interlock with the joint elements on the other portion for forming a sealless strap connection when the joint-forming portions are overlapped with said second joint-forming portion lying between said first bale and said first joint-forming portion, each said strap further having an inner side adapted to lie against said first bale and an outer side opposite the inner side, each said strap further having a third and fourth joint-forming portion lying between said first and second joint-forming portions and further having a fifth joint-forming portion lying between said first and third joint-forming portions, said third, fourth and fifth joint-forming portions each containing an array of longitudinally spaced joint elements, said strap further having a first strap severance index located between said first and fifth joint-forming portions and a second strap severance index between said third and fourth joint-forming portions, said fourth joint-forming portion spaced from said second joint-forming portion and located adjacent said second strap severance index, said fourth joint-forming portion and said second joint-forming portion including and defining a second strap segment on said bale tie primary strap, said third and fifth joint-forming portions including and defining a third strap segment on said bale tie primary strap, the joint elements on said fourth joint-forming portion being adapted to interlock with the joint elements on said second joint-forming portion, the joint elements on said third joint-forming portion being adapted to interlock with the joint elements on said fifth joint-forming portion, said strap further including a first disengageable anti-reverse bale tie engaging tab located on said first joint-forming portion projecting outwardly from said inner side of said strap and adjacent said first strap severance index, said strap further including a second disengageable anti-reverse bale tie engaging tab located on said second joint-forming portion projecting outwardly from said outer side of said strap and adjacent the distal end of said strap;

(b) forming each of said primary straps into an outwardly bowed loop about said first bale with said inner side facing the surface of said first bale;

(c) interlocking said joint elements of said first and second joint-forming portions to form a sealless strap connection in the loop with the distal end of said second joint-forming portion being biased outwardly against the inner side of said first joint-forming portion whereby said second tab is aligned with said first tab to prevent disengagement of the connection when the strap is in the outwardly bowed position;

(d) compressing said first bale to (1) move a portion of said bale surface out of contact with, and away from, said inner side of each said primary strap at said sealless connection between said first and said second joint-forming portions and (2) create slack in said loops;

(e) moving the region of each strap loop containing said sealless connection inwardly towards said compressed bale surface to reverse the outwardly bowed loop to an inwardly bowed loop in the region of said sealless connection whereby the distal end of said strap at said second joint-forming portion and said second tab thereon is moved inwardly and away from said first tab on said first joint-forming portion;

(f) displacing one of said first and second joint-forming portions longitudinally relative to the other portion in a disengaging direction to disengage said sealless connection of each strap loop;

(g) breaking each said primary strap at said first severance index and at said second severance index to separate said second and third strap segments and said first joint-forming portion;

(h) discarding said first joint-forming portion broken away from each primary strap;

(i) connecting said second strap segment severed from a primary strap with at least one other similar second strap segment from another primary strap by forming a sealless connection between the interlocking joint elements of a fourth joint-forming portion on one second segment with a second joint-forming portion on the other second segment to form at least one composite strap substantially equal in length to said third strap segment;

(j) forming at least one first smaller loop about a compressed second bale smaller than said first bale with one of said remaining third strap segments and forming a sealless connection in said third strap segment between the joint elements of said third and fifth joint-forming portions;

(k) forming at least one second smaller loop about said smaller bale with said composite strap and forming a sealless connection in said composite strap between the joint elements of the joint-forming portions on each end of said composite strap; and (l) releasing compression to allow said second bale to expand into contact with said first and second smaller loops.

* * * * *